United States Patent [19]

Hutten

[11] Patent Number: 4,623,169

[45] Date of Patent: Nov. 18, 1986

[54] CLAMP

[75] Inventor: James E. Hutten, Mason, Ohio

[73] Assignee: Ghent Manufacturing Inc., Lebanon, Ohio

[21] Appl. No.: 744,393

[22] Filed: Jun. 13, 1985

[51] Int. Cl.[4] ..... B42D 17/00; B42D 5/00; B42F 9/00

[52] U.S. Cl. ..... 281/45; 281/48; 24/67.3

[58] Field of Search ..... 281/45, 48, 49; 24/67.3, 67 R, 455; 248/225, 316.1, 464, 448; 402/5, 6, 9

[56] References Cited

U.S. PATENT DOCUMENTS

| | | | |
|---|---|---|---|
| 1,039,296 | 9/1912 | Krumming | 281/45 |
| 1,370,852 | 3/1921 | Stinger . | |
| 1,632,459 | 6/1927 | Van Valkenburgh . | |
| 1,743,718 | 1/1930 | Lotter . | |
| 1,828,417 | 10/1931 | Keleher | 24/67.3 |
| 2,282,565 | 5/1942 | Crowley | 24/67.3 |
| 2,658,773 | 11/1953 | Tarris | 281/45 |
| 2,882,633 | 4/1959 | Howell . | |
| 2,941,324 | 6/1960 | Waxgiser . | |
| 3,310,901 | 3/1967 | Sarkisian . | |
| 3,947,138 | 3/1976 | Eshelman . | |
| 4,138,787 | 2/1979 | Sarkisian et al. . | |
| 4,145,828 | 3/1979 | Hillstrom . | |

*Primary Examiner*—Paul A. Bell
*Assistant Examiner*—Paul M. Heyrana, Sr.
*Attorney, Agent, or Firm*—Wood, Herron & Evans

[57] ABSTRACT

An apparatus for clamping a pad of large papers to an upright support includes a back support adapted to mount to the upright support and a clamping member pivotally mounted to the back support and movable with respect to the back support between an open position for insertion of the paper pad between the back support and clamping member, and a closed position in which the clamping member clamps the paper pad against the back support. An elongated, extruded aluminum alloy spring is connected between the clamping member and back support for locking the clamping member in both the open and closed positions.

10 Claims, 2 Drawing Figures

CLAMP

BACKGROUND OF THE INVENTION

This invention relates to a binder apparatus, and, more particularly, to a clamping device or holder for supporting large paper pads and the like.

Holders for large paper pads used in lectures, presentations and other displays are wellknown. Such holders generally comprise a back support member having a plurality of spaced pins or pegs which is adapted to be mounted to an upright support or stand. The pins are insertable within holes formed along one edge of the paper pad for hanging the pad on the back support member, and, in turn, the upright stand. In order to prevent the papers from becoming dislodged from the pins, prior art paper pad holders also include an elongated clamping member pivotally connected to the back support member along a longitudinally extending edge. The clamping member is pivotal between a closed clamping position wherein it overlies the pins and clamps the paper pad in place, and an open position which uncovers the pins and permits the pad to be removed.

In many prior art paper pad holders, movement of the clamping member between the open and closed position is assisted by a spring device connected between the clamping member and back support member. In some pad holders, conventional coil springs are connected between the back support and clamping member to resiliently urge the clamping member in either a closed position against the paper pad or an open position. The coil springs are generally disposed within enlarged recesses formed in the clamping member which are often fully exposed in the open position of the clamping member. This detracts from the appearance of the sheet holder. In addition, the recesses tend to collect dirt which restricts full deflection of the springs and falls out onto the sheets of the paper pad.

To overcome the problems created by coil springs, prior art sheet holders have employed elongated springs having longitudinal edges connected to mating longitudinal grooves formed on the exterior of the clamping member and back support member. Conventionally, such prior art springs are formed of spring steel. In order to fabricate the springs from spring steel, the spring steel is first cut to width, shaped in the desired cross section by a roll former fixtured with the appropriate dies and then heat treated to obtain the proper hardness. The fabrication process, and particularly the forming dies, are relatively expensive which adds greatly to the cost of the paper pad holder.

SUMMARY OF THE INVENTION

In a broad aspect of this invention, a paper pad holder is provided having a back support adapted for mounting to an upright support, a clamping member pivotally mounted to the back support, and a relatively inexpensively manufactured spring adapted for connection between the back support and clamping member. The spring locks the clamping member in an open position wherein a paper pad may be placed between the clamping member and back support, and resiliently urges the clamping member against the paper pad in a closed position for mounting the paper pad to the back support.

In another aspect of this invention, the spring is preferably formed of an extruded aluminum alloy having a longitudinally-extending, convexly arcuate surface formed with integral legs at each edge which are bent inwardly toward one another. The clamping member and back support are each formed with a longitudinal groove or recess which are adapted to mount one leg of the extruded aluminum spring.

In a further aspect of this invention, the spring is preferably formed of 6063 aluminum alloy which is heat treated to a T6 temper or hardness. The thickness of the extruded aluminum spring is chosen to be thin enough to permit the clamping member to be open and closed by hand, but thick enough so that the elastic limit of the material is not exceeded in moving it with the clamping member between an open and closed position. It has been found that the spring is sufficiently stiff to lock the clamping member in an open and closed position, while retaining its memory or ability to return to its original shape after being deflected or extended, if the wall thickness of the spring is about 0.030 inch using T6 tempered 6063 aluminum alloy. In addition, as described in detail below, the arcuate top surface of the extruded aluminum spring is spaced above the pivotal connection between the back support and clamping member to avoid interference in both the open and closed positions of the clamping member.

The extruded aluminum spring of this invention extends along the length of the clamping member and back support which enhances the aesthetic appearance of the holder. Unlike prior art spring steel springs, the elongated spring of this invention is formed from an aluminum alloy in a single extrusion operation requiring no additional bending or shaping operations. This greatly reduces the cost of the holder without limiting its operation or useful life.

DESCRIPTION OF THE DRAWINGS

The structure, operation, and advantages of a presently preferred embodiment of this invention will become further apparent upon consideration of the following description, taken in conjunction with the accompanying drawings, wherein.

DETAILED DESCRIPTION OF THE INVENTION

Figure 1:
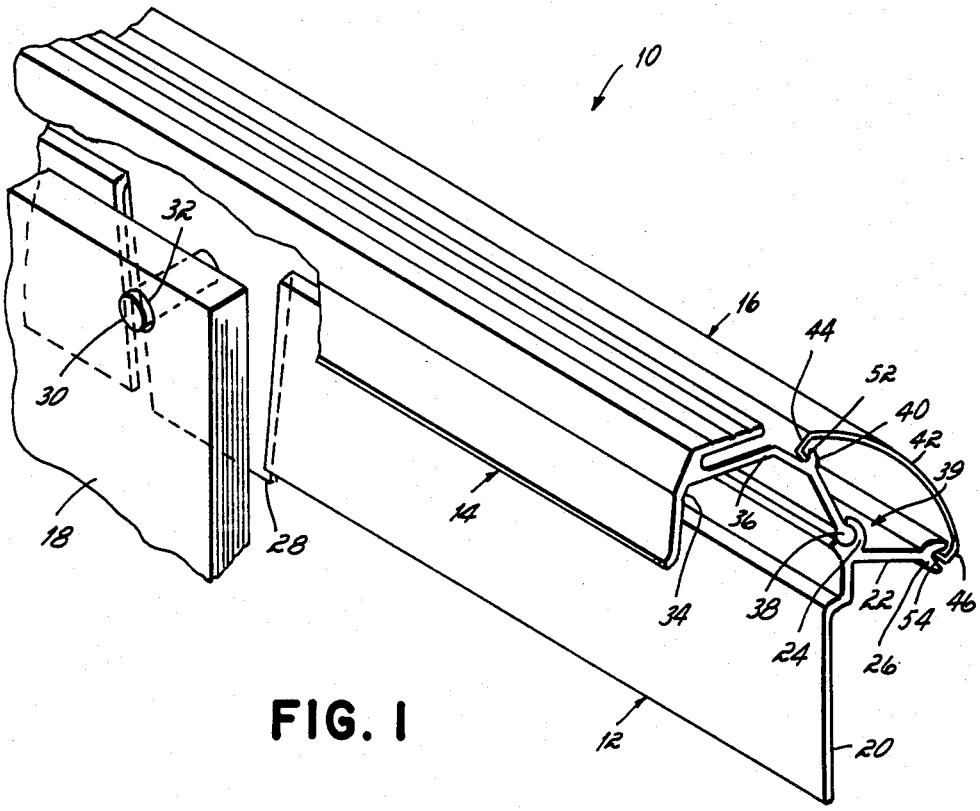
FIG. 1 is a perspective view of the clamping apparatus of this invention in an open position with a pad of paper mounted on the back support.

Referring now to the drawings, the holder 10 of this invention includes a back support 12 adapted to mount to an upright support 13, a clamping member 14 pivotally mounted to the back support 12, and an extruded aluminum spring 16 connected between the back support 12 and clamping member 14. The clamping member 14 is pivotal with respect to the back support 12 between an open position shown in FIG. 1 for receiving a paper pad 18, and a closed position shown in FIG. 2 wherein the paper pad 18 is clamped in place. The extruded aluminum spring 16 functions to lock the clamping member 14 in both the open and closed position.

More specifically, the elongated back support 12 is formed in an L-shape having a front leg 20 connected to a rear leg 22. A longitudinally-extending hinge socket 24 is formed at the juncture of front and rear legs 20, 22. The opposite end of rear leg 22 is formed with an elongated, concave channel 26 for purposes to become apparent below.

In order to mount the back support 12 to the upright support 13, front leg 20 is formed with a plurality of spaced mounting tabs 28, only one of which is shown in the figures, which are bent out of the plane of the back support 12 for insertion within slot 29 formed in the upright support 13 to mount the back support 12 atop the upright support 13. At least two of the mounting tabs 28 include a mounting peg or pin which extend through holes 32 formed along an edge of the paper pad 18 to permit the paper pad 18 to hang from the back support 12, and, in turn, upright support 13.

The clamping member 14 is generally U-shaped having a forward tear blade 34 connected to an inner member 36. The inner member 36 includes a longitudinally-extending hinge bead 38 which seats within the hinge socket 24 of back support 12. The hinge socket 24 and hinge bead 38 thus form a hinging element 39 to permit pivotal movement of the clamping member 14 with respect to the back support 12. The inner member 36 is also formed with a longitudinally-extending concave channel 40 which cooperates with concave channel 26 of back support 12 to mount spring 16 as described below.

Figure 2:
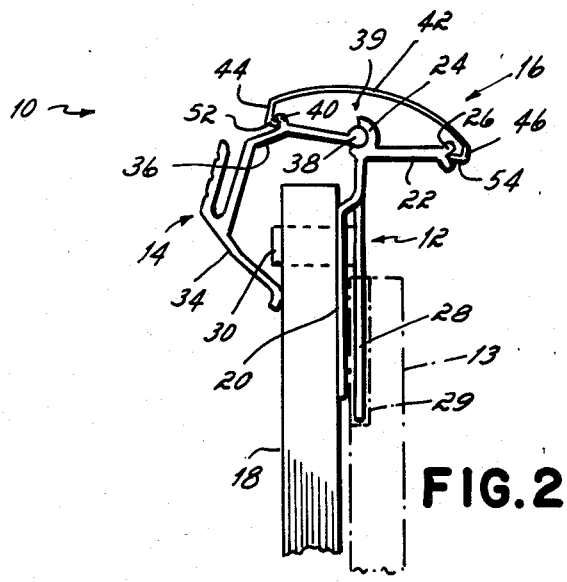
FIG. 2 is an enlarged end view of the clamping holder herein showing the extruded aluminum spring.

The clamping member 14 is pivotal with respect to the back support 12 between an open position shown in FIG. 1 and a closed position shown in FIG. 2. In the open position, the tear blade 34 of the clamping member 14 is spaced from the back support 12 to permit insertion of the paper pad 18 therebetween for placement onto the mounting pegs. In order to clamp the paper pad 18 in place, the clamping member 14 is movable to the closed position in which the tear blade 34 engages and clamps the paper pad 18 against the back support 12, and, in turn, against the upright support 13.

The back support 12 and clamping member 14 are preferably formed from an extruded aluminum alloy having a wall thickness in the range of about 0.060–0.065 inches and a length dependent on the requirements of the particular application.

The extruded aluminum spring 16 is connected between the back support 12 and clamping member 14, and functions to lock the clamping member 14 relative to the back support 12 in both the open position (FIG. 1) and the closed position (FIG. 2). As best shown in FIG. 2, the spring 16 is generally C-shaped including a longitudinally-extending, convexly arcuate top surface 42 having integral forward and rearward legs 44, 46, respectively, which are bent inwardly toward one another. The forward and rearward legs 44, 46 extend downwardly from the top surface 42 and are formed in an L-shape each having a lower, generally horizontal portion which terminate in longitudinally-extending edges 52, 54, respectively. The longitudinal edge 52 of forward leg 44 seats within the concave channel 40 of clamping member 14, and the longitudinal edge 54 of rearward leg 46 seats within the concave channel 26 of back support 12. The top surface 42 of the spring 16 must be spaced above the hinging element 39 to avoid interference therewith as the clamping member 14 moves between the open and closed positions. Although the top surface 42 is shown having an arcuate shape in the drawings, it is contemplated that other generally C-shaped cross sections could be utilized if sufficient clearance is provided for the hinge socket 24 and bead 38.

In a presently preferred embodiment of this invention, the spring 16 is extruded from 6063 aluminum alloy which is heat treated to a T6 temper or hardness. The thickness of the extruded aluminum spring is chosen to be thin enough to permit movement of the clamping member 14 by hand, but thick enough so that the elastic limit of the material is not exceeded in moving it with the clamping member 14 between an open and closed position. It has been found that the spring 16 formed of T6 tempered 6063 aluminum alloy is sufficiently stiff to lock the clamping member in an open and closed position, while retaining its memory or ability to return to its original shape after being deflected or extended, if the wall thickness of the spring 16 is about 0.030 inch.

In the open position, wherein the tear blade 34 of clamping member 14 is spaced from the back support 12, the extruded aluminum spring 16 is disposed in an essentially unstressed position. The arcuate top surface 42 is disposed in its furthest position from the hinging element 39 with the clamping member 14 open, and the legs 44, 46 are relatively close together. The angular position of the clamping member 14 relative to back support 12 is limited by the shape of hinge socket 24 which engages the inner member 36 of clamping member 14 in its open position to prevent further pivotal motion. See FIG. 1.

When the clamping member 14 is pivoted to a closed position, as shown in FIG. 2, the arcuate top surface 42 of spring 16 flattens to some extent as the forward leg 44 moves with the clamping member 14 laterally with respect to the rearward leg 46 mounted to the back support 12. As discussed above, the thickness and hardness of the extruded aluminum forming spring 16 are chosen so that such movement of the top surface 42 does not stress the the material beyond its elastic limit and therefore the spring 16 retains its memory and returns to its original shape in the open position of clamping member 14 even after repeated opening and closing of the clamping member 14.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for clamping an object such as a paper pad or the like comprising:

a back support;

a clamping member pivotally mounted to said back support, said clamping member being pivotal with respect to said back support between an open position and a closed position;

said clamping member being spaced from said back support in said open position for receiving an object therebetween, the object being clamped against said back support upon pivoting said clamping member to said closed position;

an extruded aluminum spring connected between said back support and said clamping member, said extruded aluminum spring locking said clamping member relative to said back support in said open position and in said closed position.

2. The apparatus of claim 1 in which said extruded aluminum spring is generally C-shaped including a top surface formed with opposed, longitudinally-extending legs.

3. The apparatus of claim 1 in which said extruded aluminum spring is formed of 4340 aluminum alloy having a T6 hardness.

4. The apparatus of claim 3 in which said extruded aluminum spring has a wall thickness of about 0.030 inches.

5. The apparatus of claim 1 in which said back support includes means for mounting to an upright support.

6. The apparatus of claim 1 further including hinge means for pivotally connecting said clamping member to said back support.

7. The apparatus of claim 6 in which said hinge means comprises a longitudinally-extending bead formed in said clamping member, and a mating, longitudinally-extending socket formed in said back support, said bead being pivotally received within said socket for pivotal motion of said clamping member with respect to said back support.

8. The apparatus of claim 1 in which said clamping member includes a tear blade adapted to engage said paper stack with said clamping member in said closed position.

9. The apparatus of claim 1 in which said clamping member and said back support each include a longitudinally-extending, concave channel, said extruded aluminum spring being formed with a longitudinally-extending, convexly arcuate surface having integral forward and rearward legs bent inwardly, toward one another, said forward and rearward legs each terminating with a longitudinal edge adapted to seat within one of said concave channels formed in said clamping member and said back support for mounting said extruded aluminum spring to said clamping member and said back support.

10. Apparatus for clamping a paper pad to an upright support, comprising:

a back support formed with a longitudinally-extending concave channel, said back support being adapted to be mounted to said upright support;

a clamping member formed with a longitudinally-extending concave channel;

hinge means for pivotally connecting said clamping member to said back support, said clamping member being pivotal with respect to said back support between an open position for receipt of a paper pad between said clamping member and back support and a closed position for clamping the paper pad against said back support;

an extruded aluminum spring formed with a longitudinally-extending, convexly arcuate surface having integral legs at each edge bent inwardly, toward one another, each of said legs terminating with a longitudinal edge adapted to seat within said longitudinally-extending concave channels formed in said clamping member and said back support;

said extruded aluminum spring locking said clamping member against the paper pad with said clamping member in said closed position relative to said back support, and locking said clamping member in an open position relative to said back support for removal of the paper pad therebetween.

* * * * *